United States Patent [19]

Diaz

[11] 4,374,480

[45] Feb. 22, 1983

[54] EXTENSION TOOL

[76] Inventor: William J. Diaz, 1028 W. Compton Blvd., Gardena, Calif. 90247

[21] Appl. No.: 222,710

[22] Filed: Jan. 5, 1981

[51] Int. Cl.[3] ..... B25B 17/00

[52] U.S. Cl. ..... 81/57.3; 74/421 R; 74/467

[58] Field of Search ..... 81/57.3, 57.14; 74/421 R, 467

[56] References Cited

U.S. PATENT DOCUMENTS 2,830,479 4/1958 Finn ..... 81/57.3

4,063,475 12/1977 Perkins ..... 81/57.3

FOREIGN PATENT DOCUMENTS 2713940 3/1977 Fed. Rep. of Germany ..... 81/57.3

*Primary Examiner*—James L. Jones, Jr.

*Attorney, Agent, or Firm*—Irving B. Osofsky

[57] ABSTRACT

An extension wrench for transmitting a torque to a fastener with restricted access, where conventional wrenches are not practical to use because of lack of clearance for the angular movement of the conventional wrench. The extension wrench comprises an elongated frame, housing a driven gear at one end, a driving gear at the opposite end and a meshing gear train between the driving and driven gears which transmits torque from the driving gear to the driven gear. The gears have no shafts for support but are supported on their external diametral surfaces by close fitting circular recesses in the elongated frame. The driving and driven gears have multi-faceted recesses to accept (standard square or hexagonal cross section) commercially available tools. The planform of the wrench is substantially rectangular or arcuate. Lubrication means is provided for servicing the wrench.

6 Claims, 5 Drawing Figures

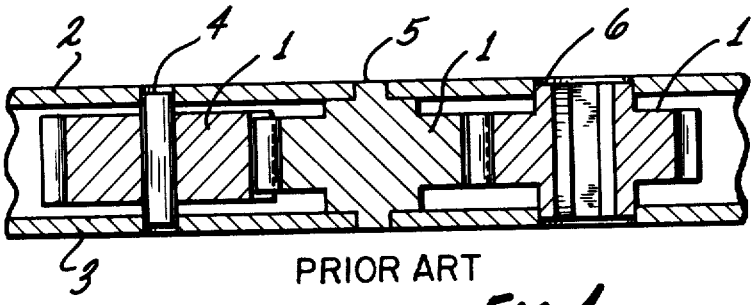
PRIOR ART
FIG. 1
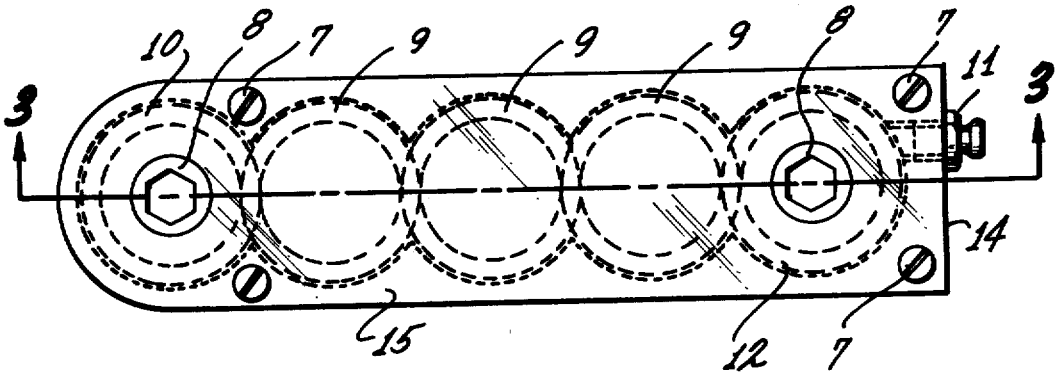
FIG. 2
FIG. 3
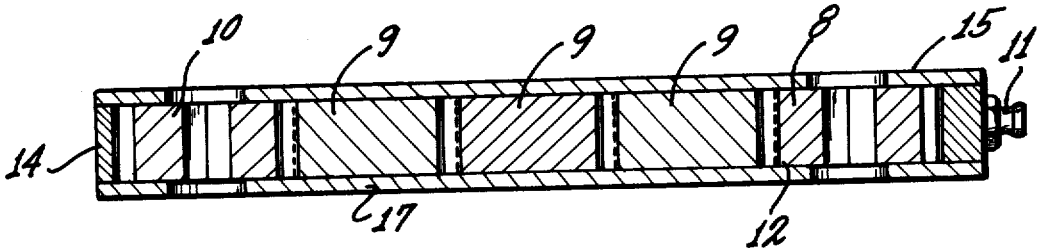

EXTENSION TOOL

BACKGROUND OF THE INVENTION

In the manufacture of aircraft, automotive and other complex mechanical assemblies, the situation often arises where screw fasteners such as bolts, nuts or screws must be torqued in a location which is restricted in access to conventional socket wrench sets, screwdrivers and hand operated box, open end or adjustable wrenches. In some cases, the factory installs a part and then hinders wrench access to the part by installing structure or other parts in the vicinity of the originally accessable part. Removal, adjustment or reinstallation of the reduced access part becomes a very difficult process and often requires disassembly of structure and/or machinery just to provide wrench access. In other cases, the aircraft, automobile or machine designer by error or oversight did not allow clearance for conventional wrench access to a part that requires maintenance or service. There are numerous special tools on the market that cater to the need for access to bolts, nuts and screws which are difficult to torque with conventional tools. The "Snap On" Tool Company, one of the largest suppliers of mechanics' tools, manufactures especially bent and shaped wrenches to fit deeply recessed parts such as distributors on cars as well as offset screwdrivers etc. all designed to ease the mechanic's job when servicing an automobile or airplane.

The need for an offset wrench has been demonstrated by the number of special wrenches available on the market and by the large number of companies that make and sell them. Almost every automobile parts supply store has racks of specialized wrenches and screwdrivers on display. Many of these are designed to fit a single model car or engine. There is a requirement and need for a general purpose offset wrench or screwdriver that the average mechanic could use on different tasks. The prior art has developed such offset torque application devices but they are either impractical or unsuitable for the average mechanic who requires a small device capable of providing torquing access in restricted quarters. The tool must be small enough to allow the mechanic to hold it with the same hand that applies the torque or to support it with a finger or two if required. U.S. Pat. No. 2,830,479 shows a design for a gear operated wrench which has an open frame supporting a gear train. This open framed device does provide means for applying torque to screw fasteners with restricted access but the open frame allows dirt and metal chips to enter the gear train and aggravate wear and breakage of the gear system. It also is a danger to the mechanic's hands because his skin could be pinched or abraded by the revolving gears as he grips the device with his hands or fingers to hold it in place. In addition, the open frame enclosing the gears is structurally deficient in that it has little restraint against torsion or bending because the frame comprises two long thin plates separated by spacers at the extremities. U.S. Pat. No. 3,987,691 shows an enclosed frame with a structurally more efficient housing that provides more rigidity but due to its greatly enlarged diameter at the driven and driving ends, the usefulness of the tool in close quarters is considerably reduced. U.S. Pat. No. 1,327,991 shows another version of an open framed wrench which has the structural limitations of the open frame and also the dangerous propensity of being capable of injuring the operator by trapping his hand between meshing gears or by abrading the operator's skin. None of these inventions has been a commercial success because they are too bulky, too limber, too dangerous to use and are susceptible to undue wear and breakage from dirt and debris.

All of the referenced patents support the gears by means of a central shaft which protrudes from each end of each gear and is supported by matching holes in the top and bottom of the housing as shown schematically in FIG. 1. This shaft or extension of the gear is really the fulcrum of a lever and sustains a load equal to twice the gear tooth force. The shaft and bearing combination are subject to wear due to the high unit loading. The lateral location of the gears depends not only on the precision with which the bearing holes are made in the housing but depend on the precision and manner in which the top and bottom of the housing are fastened together. Thus, in the case of a gear rotating about a separate shaft, there is the manufacturing tolerance (errors) between the concentricity of the bore of the gear with the pitch diameter of the gear as well as the location errors of the bearings for the shaft all added to the concentricity tolerances of the shaft and the looseness of the gear with respect to the shaft as well as the looseness between the shaft and bearings. Typically, this can add up to the order of 0.005–0.010 inches which cases uneven wear, stresses concentration on the gear teeth due to misalignment and also causes backlask to be designed into the system which in turn makes the wrench feel springy rather than firm to the operator.

SUMMARY OF THE PRESENT INVENTION

The present invention permits a wrench to be applied to screw fasteners with very restricted access which cannot readily be torqued with conventional wrenches and screwdrivers. The invention is easy to use by mechanics with no special training. The invention is safe to use and the internal mechanism is protected from contamination by dirt and chips. There is provision for lubricating the internal parts so as to prolong their life and to reduce the operating friction.

The invention comprises a non-rotating rigid elongated closed frame which transfers an input torque applied to a gear at one end of the closed frame by means of a continuous gear train within the closed frame to an output torque at a gear at the opposite end of the closed frame. The purpose of the invention is to provide the mechanic with a convenient safe means of torquing fasteners such as screws, bolts, nuts and studs which have restricted access. Torque is applied by the application of a conventional ratchet wrench to an enclosed spur or helical gear located within one end of the closed frame. The driven gear has a multi-faceted central recess which accepts the square or hexagonal cross section shaft extending from the ratchet wrench. This torque is transmitted by a series of meshing spur or helical gears to an output gear at the other end of the closed frame. The output torque is transmitted to the driven screw fastener by means of conventional square or hexagonal cross section drive wrench sockets, extension shafts, hexagon wrenches or screw driver bits which snap into multi-faceted recsses (a square or hexagonal recess) in the center of the output gear. Alternatively, the output and/or input gear could have protruding shafts to directly engage sockets, tool bits or screw fasteners.

These conventional (square or hexagon cross section) drive sockets are in common use for the building and repair of machinery, automobiles and aircraft. They consist of a lever, usually with a built in ratchet, commonly called a ratchet wrench or socket wrench, which has a projecting square or hexagonal cross section shaft. This square or hexagonal cross section shaft engages many tools such as wrenches which have a recess to engage the square or hexgaonal shaft of the driving lever. Each individual wrench is usually referred to as a socket because it is usually formed with an internal multi-faceted recess which slips over the driven screw or belt. In addition to these sockets, there have been developed and in common use, screwdriver bits, stud drivers, extension bars, universal joints, hexagon shafts and other accessories made to be driven by the standard lever ratchet wrench described above or by power driven rotary wrenches.

The invention does not utilize gears supported by central shafts and bearings. In this invention, the central part of the gear housing is made to fit the outer edge of each gear closely so that each gear outer diameter acts as a bearing. It is preferable to form the gear housing recesses by machining but adequate precision can be obtained by extrusion, forging, precision casting, button sizing and other methods commonly used by industry. The alignment of the gear train depends only on the precision of the outer diameters of the gears as they fit into the machined recesses of the housing. Typically, the centers of the gears can be readily positioned within 0.001 of theoretical location. Therefore, with this design, it is possible to economically achieve precision, rigidity and minimal thickness.

BRIEF DESCRIPTION OF THE DRAWINGS

FIG. 1 is a sectional view of a conventional assembly of a gear train wherein the gears are mounted on bearings which support a central shaft.

FIG. 2 is a top view of the offset torque wrench assembly.

FIG. 3 is a longitudinal cross sectional view of the assembled torque wrench.

DETAILED DESCRIPTION OF THE INVENTION

Figure 4:
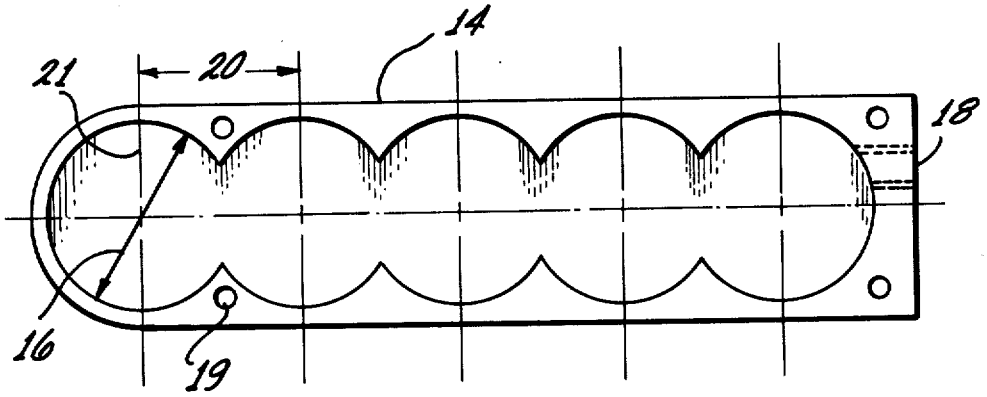
FIG. 4 is a top view of the gear housing portion of the offset torque wrench.

Referring now in detail to FIG. 1, there are illustrated three methods of mounting a gear into the conventional torque wrenches disclosed in the references. A gear 1, is held by an upper housing 2, and lower housing 3, by means of a shaft 4, which fits within holes in the housings. The shaft may be loose in the gear, integral with the gear or a force fit in the gear. The shaft may be loose in the housing or a force fit in the housing if the gear is free to rotate about the shaft. In any case, the alignment of the gear train is dependent on the machining tolerance and concentricity of the gear, shaft and holes in the housing. Alternatively, gear and shaft 5, are formed from a single piece of metal to eliminate the extra shaft and gear 6, is formed with a relatively large hollow shaft to enable it to be driven by a conventional square or hexagonal cross section male wrench.

In all of these designs, at least three parts must fit together to form an assembly and the fit and location of the upper housing with respect to the lower housing is critical to the operation of the part. FIG. 2 is a top view of a preferred embodiment of the present invention.

FIG. 3 is a cross sectional view of the preferred embodiment. The wrench means of the present invention has a number of advantages over previous designs. It is simpler and less costly to manufacture in that there are fewer parts and fewer precision holes in the assembly. A driven gear 10, with a multi-faceted central hole 8, which can be of square or hexagonal cross section is driven by a series of idler gears 9, which in turn are driven by a driving gear 12, which has a multi-faceted central hole 8, which can be of square or hexagonal cross section. The holes in the driving and driven gears are designed to accept the standard conventional socket set drivers, extension shafts, wrenches and screwdrivers as used throughout the country by mechanics. These tools generally have square or hexagonal cross section shafts extending from the drivers which fit into mating cross section recesses on the driven tools. No further description need be given because such tools are available and are in common use by anyone with ordinary skill as a mechanic. The gears in this invention are lubricated by means of a grease or oil fitting 11, which fits into a threaded hole in the end of the gear housing 14. This fitting preferentially has a spring loaded ball check valve to seal out dirt and to retain lubricant but a simple hole is adequate. The number of gears in the gear train is determined by the length of the tool and by the diameter of the gear used. For this example, five gears are shown. Odd numbers of gears are used if the driven gear is to have the same sense of rotation as the driving gear. A fastener means such as a number of screws 7, hold the upper cover 15, gear housing 14, and lower cover 17, together. Four screws are shown but two or more can be used. The screws may be recessed as shown to provide a smooth surface and may be threaded into the gear housing or into one of the covers. The method of assembling the gear housing and covers is unimportant to the operation of the invention. Screws, rivets, spot welds or equivalent fastening means could be used with no change in function. Holes 16, are provided in the upper and lower covers to provide access to the driving and driven gears from either side but access can be alternatively provided to only one side of the gears with no change in functional capability of the wrench means.

Figure 5:
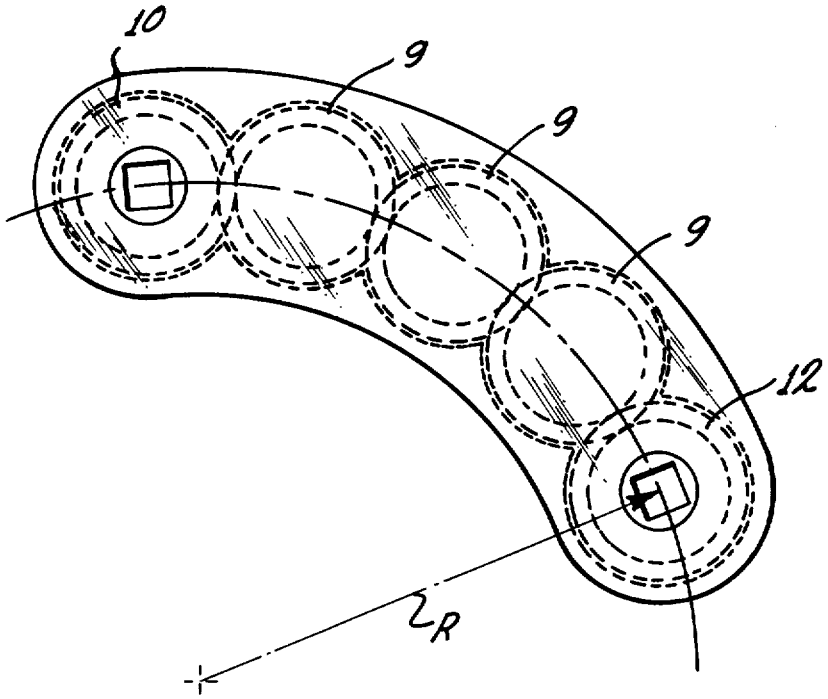
FIG. 5 is a top view of the offset torque wrench assembly with the gear housing formed as a circular arc.

FIG. 4 shows the gear housing 14, which is the main feature of the invention. It comprises a plate which is a few thousandths of an inch thicker than the gear train to allow for free angular motion of the gears when the covers are tight. The gear housing is formed with a series of circular arcs of diameter 16, which are designed to contain the gears and act as "sleeve" bearings on the periphere of the gear teeth. Typical clearance between the "bearing" diameter of the housing and the outside diameter of the gear would be approximately 0.001 inches. The actual bearing pressure on the surface of the gear and bearing is relatively small because of the large projected area actuating under load. The center of each recessed arc is spaced a distance 20, from the center of each other recessed arc where the distance 20, is equal to the pitch diameter of the gear train. The holes 19, are for the screws 7, which hold the assembly together. The lubrication fitting 11, for grease or oil, screws into a threaded hole 18, in the end of the gear housing. Said fitting may alternatively be pressed or cemented into a simple hole. Alternatively, a hole in the gear housing may suffice. Multiple fittings or holes can be used. Only one is illustrated and its position, although preferred, is not critical to the function of the invention. In some cases, no lubrication hole or fitting may be provided and reliance will be placed on factory installed lubrication means. FIG. 5 shows a top view of an alternative wrench means design for use in very restricted quarters wherein the planform of the gear housing and covers is in the form of a circular arc of radius, R. This allows the wrench means to be used in places where a straight wrench will not fit. The action of the gears remains unchanged.

The advantages of this construction over previous designs are as follows:

1. Cost of production is lower because only the gears and gear housing are precision parts.

2. The gears, as designed for this invention, are simpler than gears with shafts and/or holes and hence are cheaper to make than gears with shafts and/or holes.

3. The precision of the gear alignment is more readily attained because the number of precision mating parts is reduced to two (the gear and the housing).

4. A more rigid assembly is formed by the heavy gear housing joined to one or two covers which are not pierced for shaft holes used to support idler gears. The holes for access to the driving and driven gears are minimal in diameter. One cover may be integral with the gear housing to further enhance rigidity.

5. The mechanic's hand is protected from grease or lubricant which may leak from idler gear shaft holes. There are no such holes needed in this embodiment.

6. A lubrication means for grease or oil lubrication is included in the design to assist with proper maintenance. Such lubrication means are not essential to the proper functioning of this invention but eases maintenance. Initial lubrication could be provided during assembly of the wrench means. Follow-up lubrication during use of the wrench means could require disassembly of the wrench means to allow entry of lubricant.

7. Because of the improved gear support and alignment, the backlash in the wrench means should be reduced.

The inventor used steel gears in an aluminum alloy housing for his working model but a steel housing would enhance the rigidity of the system. Therefore, the preferred embodiment would use steel gears and a steel housing.

While certain exemplary embodiments of this invention have been described above and are shown in the accompanying drawings, it is to be understood that such embodiments are merely illustrative of, and not restrictive on, the broad invention and that we do not desire to be limited in our invention to the specific constructions or arrangements shown and described, because various other obvious modifications may occur to persons having ordinary skill in the art.

What is claimed is:

1. A wrench means for transmitting a torque to a screw fastener with restricted access, said wrench means comprising a non-rotating rigid elongated closed frame with a driven gear at one end, a driving gear at the opposite end, said driving and driven gears having multi-faceted recesses which accept standard square drive socket wrench components including ratchet wrenches, a gear train between the driving gear and driven gear including one or more idler gears all meshed together to provide a continuous torque transmission from the said driving gear to the said driven gear, all of said gears mounted into closely fitting circular recesses in said elongated closed frame, all of said gears completely supported on their outer diameters by said closely fitting circular recesses with the outer periphere of each gear acting as a shaft, with the said closely fitting circular recesses acting as bearings, said gears having no central supporting shafts, said gears retained into said elongated frame by one or more covers, said covers fastened to said elongated frame by fastener means and said covers and said elongated frame allowing external access to the driving and driven gears.

2. The wrench means as defined in claim 1 wherein elongated body is in the shape of a circular arc so as to make the wrench useable in very restricted areas.

3. The wrench means as defined in claim 1 wherein the recess in the driven gear is hexagonal in planform.

4. The wrench means as defined in claim 1 wherein the recess in the driving gear is hexagonal in planform.

5. The wrench means as defined in claim 1 wherein the driven gear has a concentric protruding shaft of square cross section to mate with standard square drive socket wrenches.

6. The wrench means as defined in claim 1 wherein the driven gear has a concentric protruding shaft of hexagonal cross section to mate with standard hexagonal drive socket wrenches and fasteners.

* * * * *